United States Patent [19]

Braun et al.

[11] Patent Number: 4,689,746

[45] Date of Patent: Aug. 25, 1987

[54] MIXTURE METERING ARRANGEMENT FOR AN INTERNAL COMBUSTION ENGINE

[75] Inventors: Günter Braun, Freiberg am Neckar; Werner Jundt, Ludwigsburg; Norbert Miller, Abstatt; Jürgen Näger, Ludwigsburg, all of Fed. Rep. of Germany

[73] Assignee: Robert Bosch GmbH, Stuttgart, Fed. Rep. of Germany

[21] Appl. No.: 701,493

[22] Filed: Feb. 14, 1985

[30] Foreign Application Priority Data

Feb. 18, 1984 [DE] Fed. Rep. of Germany ..... 3405916

[51] Int. Cl.[4] ..... F02B 3/00

[52] U.S. Cl. ..... 364/431.05; 364/569; 364/177

[58] Field of Search ..... 364/431.05, 431.08, 364/571, 569, 176, 177, 184; 318/621; 377/16

[56] References Cited

U.S. PATENT DOCUMENTS

| | | | |
|---|---|---|---|
| 4,195,337 | 3/1980 | Bertrand et al. | 364/177 |
| 4,345,194 | 8/1982 | Green | 318/621 |
| 4,409,650 | 10/1983 | Noguchi | 364/177 |
| 4,472,776 | 9/1984 | Deleris et al. | 364/569 |
| 4,535,736 | 8/1985 | Taura et al. | 364/431.05 |
| 4,551,803 | 11/1985 | Hosaka et al. | 364/431.05 |

*Primary Examiner*—Parshotam S. Lall
*Attorney, Agent, or Firm*—Walter Ottesen

[57] ABSTRACT

The invention is directed to a mixture metering arrangement for an internal combustion engine with a digital data processor, particularly a microcomputer, the signal processing pattern of which is governed by clock pulses, and with a signal generating means which delivers analog output signals. The signal generating means is responsive to operating parameters of the internal combustion engine and is an exhaust gas sensor responsive to the air ratio Lambda. The exhaust gas sensor is used in a closed-loop control system to influence the air-fuel ratio and changes its output quantity at the air ratio of Lambda = 1. In this arrangement, a correcting stage corrects the influence of a delay time ($t_v$) connected with the clocked signal processing on the mixture formation. The delay occurs in the transmission of the change in the output of the sensor. Two methods are indicated for the mode of operation of the correcting stage by means of which a mean value shift of the quantity ($F_R$) influencing the mixture formation is avoided and the concentration of toxic substances in the exhaust gases is minimized. Flowcharts are disclosed to realize the invention by means of a suitably programmed microcomputer.

12 Claims, 9 Drawing Figures

FLOWCHART FOR FIRST METHOD

FLOWCHART FOR SECOND METHOD

MIXTURE METERING ARRANGEMENT FOR AN INTERNAL COMBUSTION ENGINE

FIELD OF THE INVENTION

The invention relates to a mixture metering arrangement for an internal combustion engine with a digital arithmetic unit such as a microcomputer. The signal processing sequence of the arithmetic unit is tied to clock pulses. The arrangement further includes a signal generator sensitive to the operating parameters of the engine. The signal generator can be an exhaust gas probe sensitive to the air ratio lambda. The signal generator is placed in a control loop for influencing the air-fuel ratio of the air-fuel mixture.

BACKGROUND OF THE INVENTION

A mixture metering arrangement of this type is disclosed in German published patent application DE-OS No. 3,124,676 for example. Although the known system operates satisfactorily in practice, it has been shown that, in view of the high demands made on the elimination of toxic substances in the exhaust gas, further improvements are possible and necessary.

SUMMARY OF THE INVENTION

By contrast, the mixture metering arrangement for an internal combustion engine with a digital arithmetic unit according to the invention makes it possible to provide the internal combustion engine with an optimum mixture independently of the point of time when the output quantity of a signal generating means changes relative to the clocked, delayed signal processing of this output signal. Particularly by correcting the influence of a delayed transmission of the change in the sensor output quantity, it is possible to provide for a low concentration of toxic substances in the exhaust gas. It is advantageous to influence the metering of the mixture in a corrective fashion in dependence on at least the delay time and/or the clock pulse of the digital arithmetic unit or data processor.

Further advantages of the invention will become apparent from the subsequent description of the embodiments thereof in conjunction with the drawing and from the claims.

BRIEF DESCRIPTION OF THE DRAWING

The invention will now be described with reference to the drawing wherein.

DESCRIPTION OF THE PREFERRED EMBODIMENTS OF THE INVENTION

Figure 2:
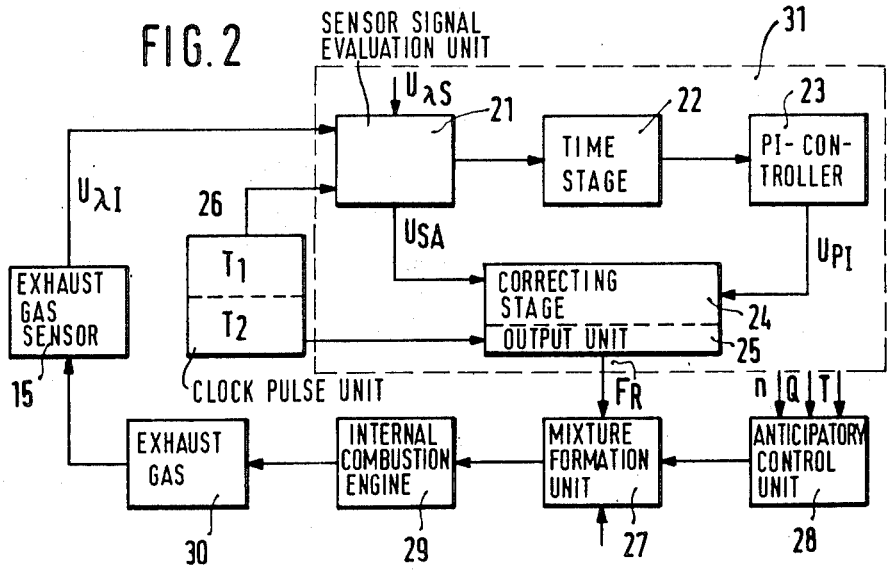
FIG. 2 is a block diagram of a mixture metering arrangement according to the invention.

The following embodiments will be described in connection with a fuel injection apparatus. It is to be noted, however, that the mixture metering arrangement, in combination with the correcting function of the invention, is independent of the method of mixture metering, so that the invention is also suitable for use with carburetor apparatus, for example. Also, representing the mixture metering arrangement of the invention in the form of a block diagram as shown in FIG. 2 does not restrict a practical embodiment to a single application. The application by means of a freely programmable computer presents no difficulty because the invention as such is clearly recognizable and accordingly poses no problems at all for one skilled in the art of electronic mixture metering systems.

Figure 1:
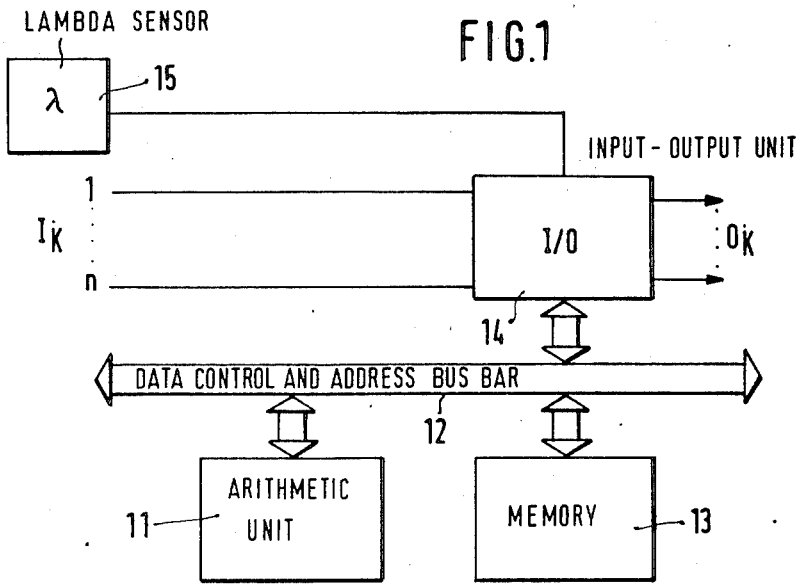
FIG. 1 is a schematic of a mixture metering arrangement incorporating a microcomputer.

FIG. 1 schematically outlines a computer-controlled system with its major components. Reference numeral 11 identifies an arithmetic unit coupled to a memory 13 and to an input-output unit 14 via a data control and address bus 12. The input-output unit 14 receives a signal from a signal generator means such as a sensor 15 which can especially be a Lambda sensor. In addition, unit 14 receives several input quantities $I_K$ and issues various output quantities $Q_K$ such as a signal indicative of the duration of injection for the fuel quantity to be metered or a signal for the actuator in an air bypass of a carburetor apparatus.

In FIG. 2, an embodiment of the invention is shown in the form of a block diagram. The sensor is identified by reference numeral 15 and is configured as an exhaust gas sensor in this embodiment. The sensor 15 delivers an output quantity $U_{\lambda I}$ to a sensor signal evaluating unit 21 which, in turn, is connected via a time stage 22 to a control unit 23 preferably configured as a PI-controller. Further, sensor signal evaluating unit 21 and control unit 23 are connected to a correcting stage 24 to which an output unit 25 is also connected. In particular, different clock pulses from a clock pulse unit 26 are applied to output unit 25 as well as to sensor signal evaluating unit 21. In addition, a desired value information $U_{\lambda S}$ representing the desired value for the air-fuel ratio to be metered to the internal combustion engine is applied to sensor signal evaluating unit 21.

Signals $F_R$ of output unit 25 as well as the signals from an anticipatory control unit 28 are applied to a mixture formation unit 27. The anticipatory control unit 28 processes input quantities relating to such operating parameters of the internal combustion engine such as rotational speed, load, temperature, or the like. Mixture formation unit 27 influences an internal combustion engine 29 and the exhaust gas 30 expelled by the internal combustion engine circulates around the exhaust gas sensor 15 and influences the sensor output quantity $U_{\lambda I}$ thereby closing the mixture formation control loop. It is to be understood that the functions of sensor signal evaluating unit 21, time stage 22, control unit 23 as well as correcting stage 24 and output unit 25 may also be performed using a suitably programmed microcomputer 31 indicated in FIG. 2 by a broken line enclosure. Also, the anticipatory control which is performed by means of the anticipatory control unit 28 as well as the clock pulse unit 26 may be integrated into the microcomputer 31.

Figure 3:
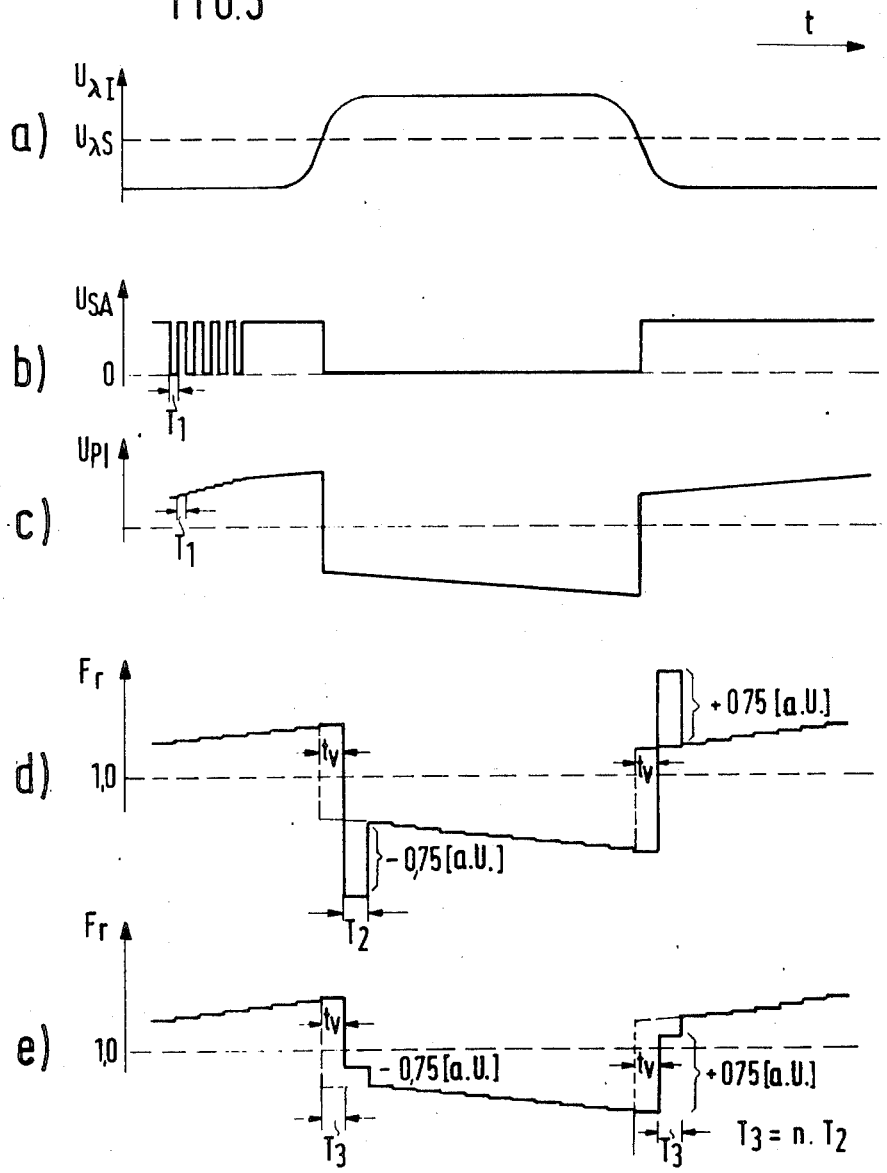
FIG. 3*a*–3*e* are timing diagrams to explain the operation of the mixture metering arrangement of FIG. 2.

With the exception of the clock pulse unit 26, correcting stage 24 and output unit 25, this arrangement is sufficiently known so that its mode of operation need not be explained in greater detail. A fact important for the invention is that the digitally clocked data processing causes a delayed transmission of the change in the output quantity $U_{\lambda I}$ to the mixture formation unit 27 for influencing the air-fuel ratio by superposition, the output quantity $U_{\lambda I}$ being preferably analog. The timing diagrams shown in FIG. 3 serve to explain the situation connected therewith. In this connection, FIG. 3*a* shows the output signal $U_{\lambda I}$ of sensor 15 for the special case wherein the sensor 15 is configured as a (Lambda=1) sensor. In FIG. 3*a*, a low output signal level corresponds to a lean air-fuel mixture and a high output signal level corresponds to a rich air-fuel mixture. In sensor signal evaluating unit 21, the exhaust gas sensor output quantity $U_{\lambda I}$ is compared with the desired value $U_{\lambda S}$ and scanned with a counting frequency having a period $T_1$. The corresponding output signal $U_{SA}$ of sensor signal evaluating unit 21 is plotted in FIG. 3*b*. This signal, which may be delayed by a desired amount of time, is routed directly to correcting stage 24 and indirectly to control unit 23 via time stage 22 which essentially serves to shift the mean air-fuel ratio.

The output signal $U_{PI}$ of control unit 23 is plotted in FIG. 3*c*. In the present embodiment, this signal exhibits an integral action for a constant output level of the exhaust gas sensor 15 and a proportional action on a change in the output level.

As is known in the art, the output signals of control unit 23 act, via output unit 25, on mixture formation unit 27 in a multiplicative manner, for example, by a factor $F_R$. Since for various program-related reasons the duration $T_2$ between two consecutive outputs of output unit 25 generally assumes different values compared to scanning frequency $T_1$, time delays may occur between the actual response of the sensor and the transmission of this response through output unit 25 as is illustrated in FIGS. 3*d* and 3*e*, the values of the duration $T_2$ being in particular higher values. From this, more or less short-term mean value shifts of output signal $F_R$ may result, possibly resulting in a substantial deviation from the air ratio required for catalytic exhaust gas after treatment, where applicable.

To avoid these disadvantages and a resultant high concentration of toxic substances which cannot even be reduced by a catalyst, it is necessary to correct the deviation caused by the delayed output of quantity $F_R$ as soon as possible by some intervention. For this purpose, correcting stage 24 is required whose mode of operation will be explained in more detail in the following.

FIG. 3*d* shows the quantity $R_R$ which is issued by correcting stage 24 via output unit 25 at clock frequency $T_2$. The symbol $t_v$ identifies the time delay occurring in the transmission of the change in the output quantity of exhaust gas sensor 15 as a result of the different processing times in the microcomputer. The course of the signal which would apply without the action of the output unit 25 and correcting stage 24 is shown by a broke line. FIG. 3*d* shows that the delayed output causes a displacement of the mean value of output signal $F_R$, because the area ratio for the areas above and below the broken line at $F_r=1$ changes. This results at least temporarily in a change in the air-fuel ratio supplied to the internal combustion engine.

To avoid this mean value displacement, two possibilities are now proposed. In either case, the delay time, which is obtained from the difference between the change in the exhaust gas sensor output quantity and the actual output (see FIG. 3*b* in conjunction with FIG. 3*d*), is put in relation to clock time $T_2$. To determine a correction value with the first method, this value is multiplied by the quantity Δ Output obtained (with suitable scaling) from the difference between the new output quantity and the old output quantity of sensor signal evaluating unit 21, for example. In the present special case, the ratio of delay time to clock time $T_2$ is about 0.75 and the value Δ Output from FIG. 3*b* is (−1), so that the correction value amounts to (−0.75) arbitrary units (related to the scale of FIG. 3*c*). At the next response action of the sensor, the same ratios are present, however, with the sign for Δ Output being reversed, which results in a correction value of (+0.75) arbitrary units. Accordingly, the correction value is calculated applying the following computation rule:

$$\text{Correction Value} = (\text{Delay Time } t_v/\text{Clock Time } T_2)\cdot(\Delta\ \text{Output}),$$

wherein:

$$\Delta\ \text{Output} = \text{New Output Quantity} - \text{Old Output Quantity}.$$

Figure 4:
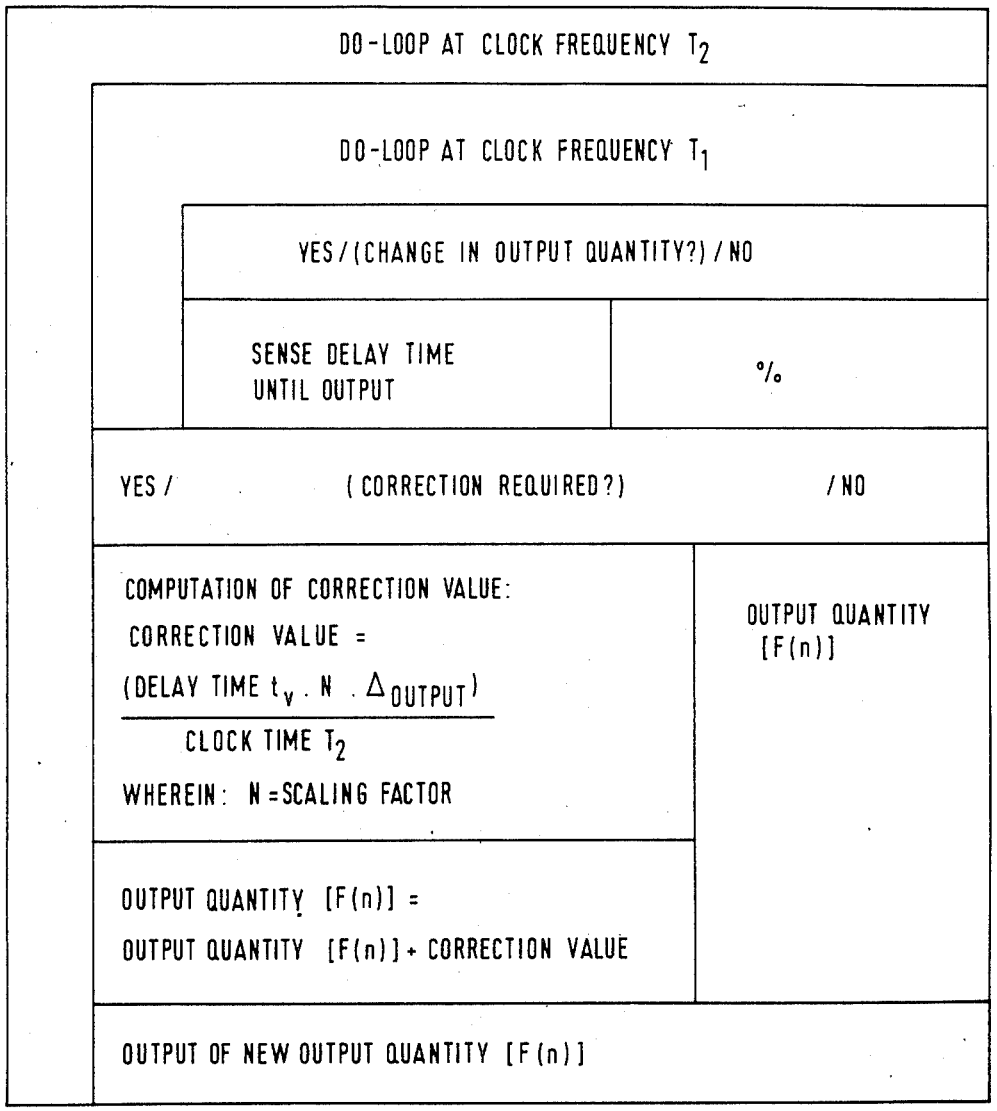
FIG. 4 is flowchart of a first method for modifying the output quantity $F_R$; and, FIG. 5 is a flowchart of a second method for modifying the output quantity $F_R$.

The relevant output quantity $F_R$ is modified by this correction value (see Flowchart for First Method shown in FIG. 4) with possibly necessary scaling factors for Δ Output having not been taken into account. Generally, scaling is required for the conversion of the output quantity (Δ Output) into units of output quantity $F_R$.

Figure 5:
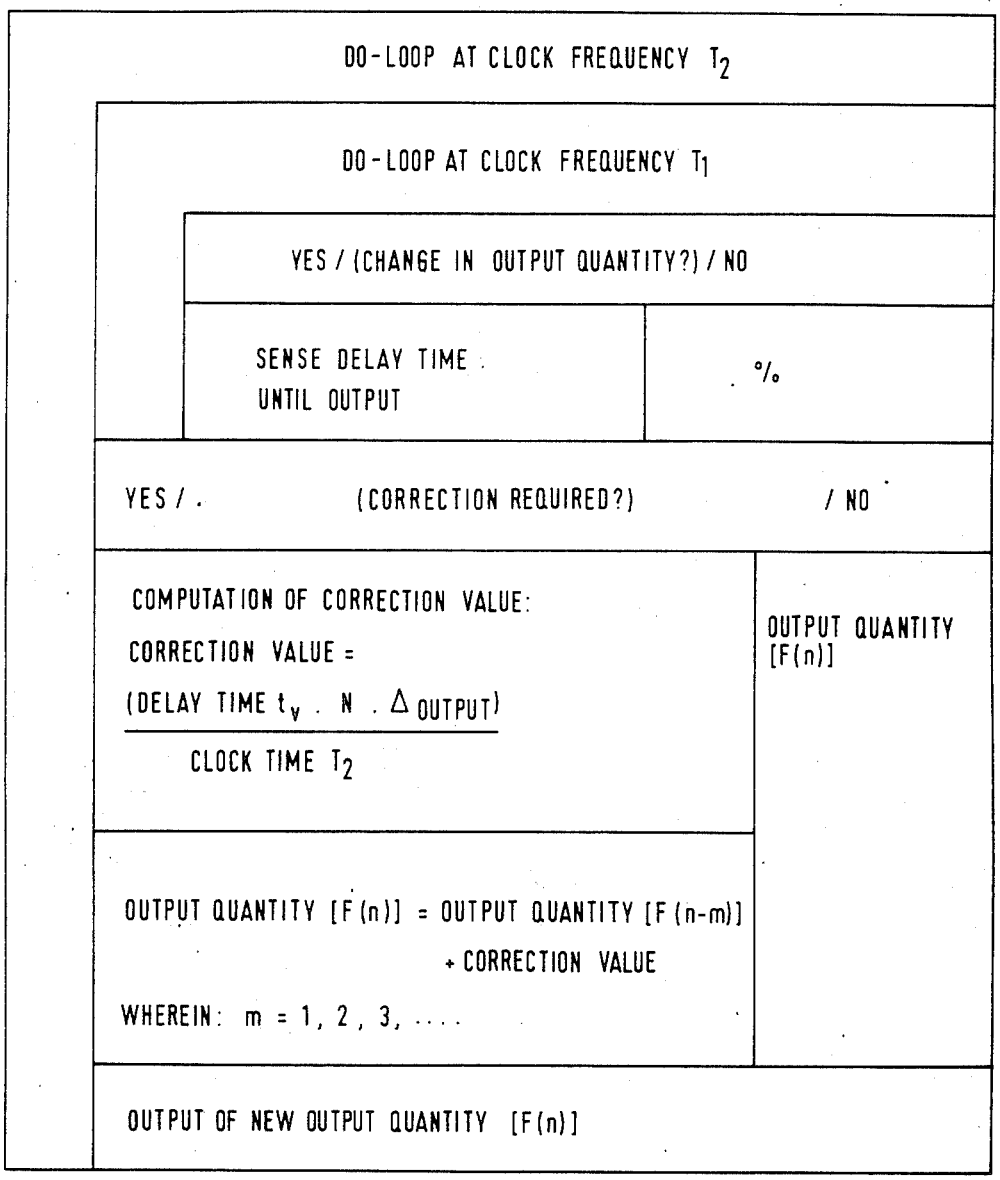

The second method shown in FIG. 5 is based on the concept of processing a change in the output signal at a delay time of at least one clock time $T_2$. During this delay time which may comprise several, for example, n clock times $T_2$, a quantity computed according to the formula given below is issued as output quantity $F_R$, with scaling factors being neglected:

$$\text{New Output Quantity} = \text{Old Output Quantity} + (\text{Delay Time } t_v/\text{Pulse Time } T_2)\cdot\Delta\ \text{Output},$$

wherein:

$$\Delta\ \text{Output} = \text{New Output Quantity} - \text{Old Output Quantity}$$

With respect to the above, reference can be made to the Flowchart for Second Method. The time plot of output quantity $F_R$ occurs in a manner corresponding to the first embodiment (FIG. 3*d*) and is shown in FIG. 3*e*.

Whereas the embodiment according to the invention shown in FIG. 2 is in the form of a block diagram for reasons of clarity, an implementation by means of a suitably programmed microcomputer is also conceivable. To explain the pertinent program structure, the two flowcharts referred to above are presented herein and relate to the two methods for determining the correction value.

The embodiments of the invention were described with reference to a Lambda-controlled mixture metering arrangement for an internal combustion engine. It is to be understood, however, that the invention is not limited to a Lambda-controlled mixture metering arrangement. The invention may be applied whenever the integral action of the output signals of a sensor or probe or generally of a signal generating means is of relevance particularly for mixture metering, and if a time delay occurs because of the clocked, delayed signal processing of these signals. As further methods for controlling the mixture composition of an internal combustion engine to which the invention is applicable, idle air charge control, control of exhaust gas recirculation, knock control, extreme-value control, and the like are mentioned as examples.

It is understood that the foregoing description is that of the preferred embodiments of the invention and that various changes and modifications may be made thereto without departing from the spirit and scope of the invention as defined in the appended claims.

What is claimed is:

1. A mixture metering arrangement for an internal combustion engine comprising:

a control loop for influencing the air-fuel ratio of the air-fuel mixture supplied to the engine;

signal generating means arranged in said control loop and being sensitive to operating parameters of the engine, said signal generating means providing an output quantity;

a digital arithmetic unit receiving said output quantity for processing the same;

clock frequency generating means for generating clock frequencies for timing the signal processing sequence of said arithmetic unit;

air-fuel mixture formation means for forming the air-fuel mixture supplied to the engine, said mixture formation means receiving changes in said output signal via said arithmetic unit; and, corrective function means for correcting the influence of a delay time ($t_v$) in the transmission of said changes to said mixture formation means, said delay time ($t_v$) being produced as a consequence of the clocked signal processing of said output quantity.

2. The mixture metering arrangement of claim 1, said digital arithmetic unit being a microcomputer, said signal generating means being an exhaust gas probe sensitive to the air ratio lambda and said output quantity being an analog signal.

3. The mixture metering arrangement of claim 2, wherein said corrective function means determines a corrective value in dependence upon at least the detected delay time ($t_v$).

4. The mixture metering arrangement of claim 2, wherein said corrective function means determines a corrective value in dependence upon a clock time ($T_2$) of said digital arithmetic unit.

5. The mixture metering arrangement of claim 2, wherein said corrective function means determines a corrective value in dependence upon the change of the output quantity (Δ Output) of said signal generating means.

6. The mixture metering arrangement of claim 4, wherein said corrective function means determines a corrective value according to the arithmetic rule:

$$\text{Corrective Value} = (\text{Delay Time } t_v / \text{Clock Time } T_2) \cdot (\Delta \text{ Output}) \cdot (N)$$

wherein:

$$\Delta \text{ Output} = n-\text{te Output Quantity} - (n-1)-\text{te Output Quantity}$$

$$N = \text{scaling factor.}$$

7. The mixture metering arrangement of claim 4, wherein output quantities ($F_R$) lying back in time at least one clock time $T_2$ are processed by said corrective function means after a change of said output quantity to determine an output quantity ($F_R$).

8. The mixture metering arrangement of claim 7, wherein said corrective function means determines an output quantity ($F_R$) changed by the amount of the corrective value during the time of said at least one clock time ($T_2$).

9. The mixture metering arrangement of claim 8, wherein said output quantity ($F_R$) for forming the mixture is formed pursuant to the following arithmetic rule:

$$n-\text{te Output Quantity} = (n-m)-\text{te Output Quantity} + \text{Correction Value}$$

wherein: $m = 1, 2, 3, \ldots$.

10. The mixture metering arrangement of claim 4, wherein an output quantity ($F_R$) lying back in time by an amount less than a clock time ($T_2$) is processed to determine an output quantity ($F_R$) by said corrective function means after a change of the output quantity of said signal generating means.

11. The mixture metering arrangement of claim 10, said output quantity ($F_R$) for forming said mixture being formed pursuant to the arithmetic rule:

$$n-\text{te Output Quantity} = n-\text{te Output Quantity} + \text{Correction Quantity.}$$

12. The mixture metering arrangement of claim 2, wherein said output quantity ($F_R$) is corrected only by one correction value when there is a change of the output quantity of said signal generating means.

* * * * *